United States Patent [19]

Miles et al.

[11] 4,326,315

[45] Apr. 27, 1982

[54] FILM CLEANER

[75] Inventors: Felix A. Miles; Dale P. Roush, both of Amarillo, Tex.

[73] Assignee: Ingenuity Incorporated, Amarillo, Tex.

[21] Appl. No.: 113,826

[22] Filed: Jan. 21, 1980

[51] Int. Cl.[3] ..... A47L 15/00; G03G 21/00

[52] U.S. Cl. ..... 15/77; 355/15

[58] Field of Search ..... 355/15, 16, 77; 15/77, 15/102; 134/122 R, 122 P

[56] References Cited

U.S. PATENT DOCUMENTS

| | | | |
|---|---|---|---|
| 2,690,696 | 10/1954 | Ashton | 355/53 |
| 3,480,361 | 11/1969 | Doi et al. | 355/16 |
| 3,534,427 | 10/1970 | Severynse | 355/15 |
| 3,712,733 | 1/1973 | Giaimo | 355/16 |
| 3,795,025 | 3/1974 | Sadamitsu | 355/15 |
| 3,945,077 | 3/1976 | Elsbery et al. | 15/77 |

*Primary Examiner*—Monroe H. Hayes

*Attorney, Agent, or Firm*—Wendell Coffee

[57] ABSTRACT

A used roll of photostatic film is guided through a series of bunny brushes and vacuum nozzles to reclaim the film. The brushes pick particles from the film. The vacuum nozzles, connected to a blower, remove the particles from the brush. The reclaimed film is then rewound on a core. The process of reclaiming this web of photostatic film carefully guides the web from the used roll through the brushes to the rewinding spool without creasing the web.

7 Claims, 8 Drawing Figures

Fig. 1
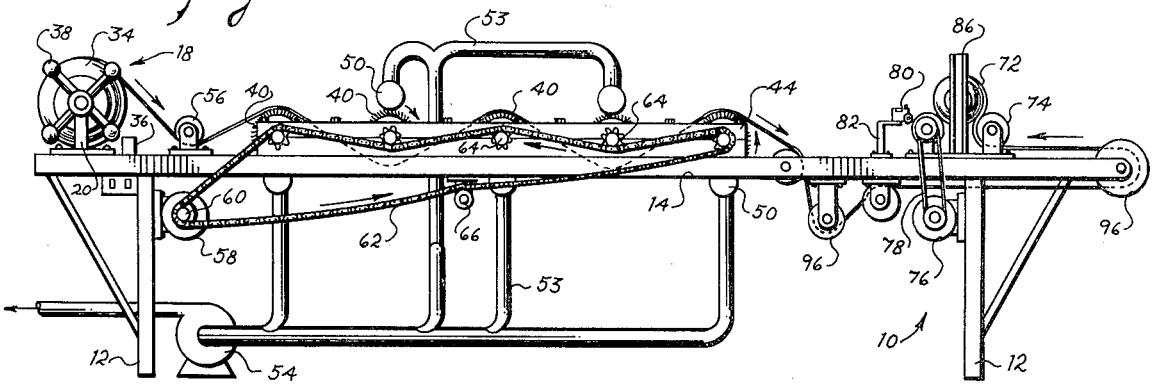
Fig. 2
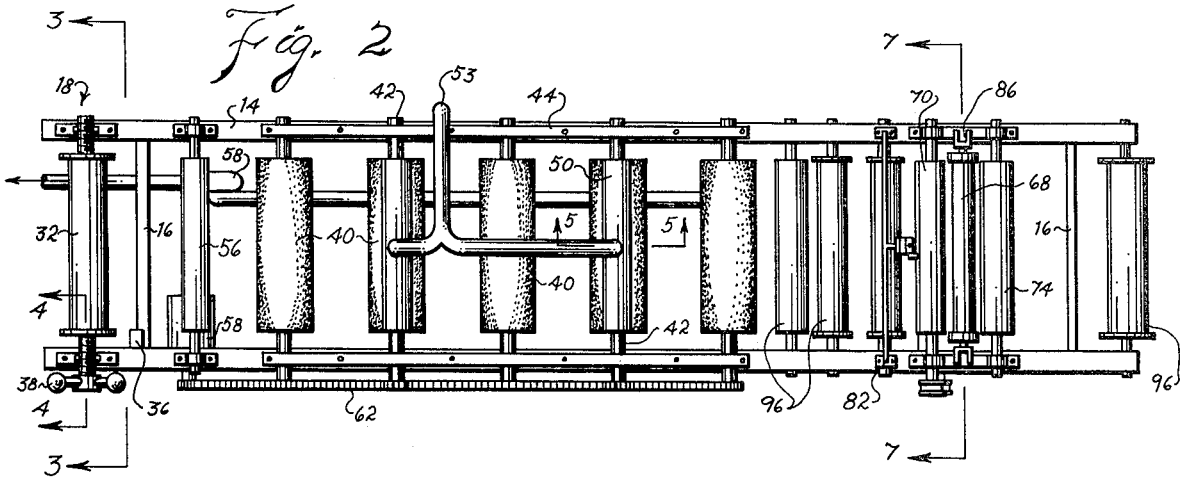
Fig. 4
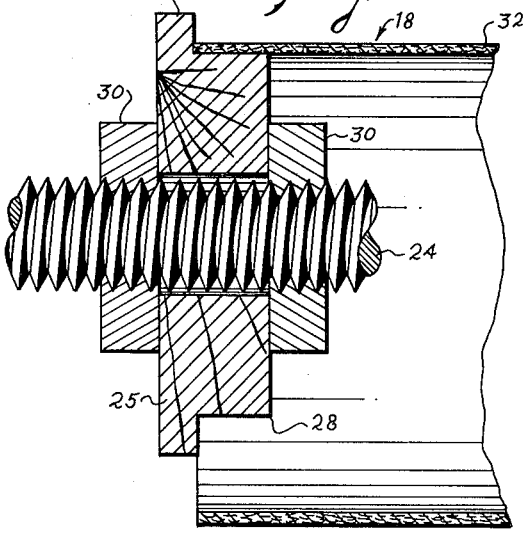
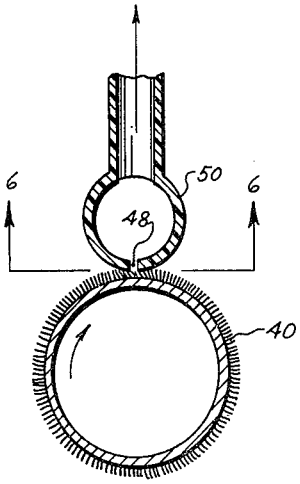
Fig. 5

Fig. 3
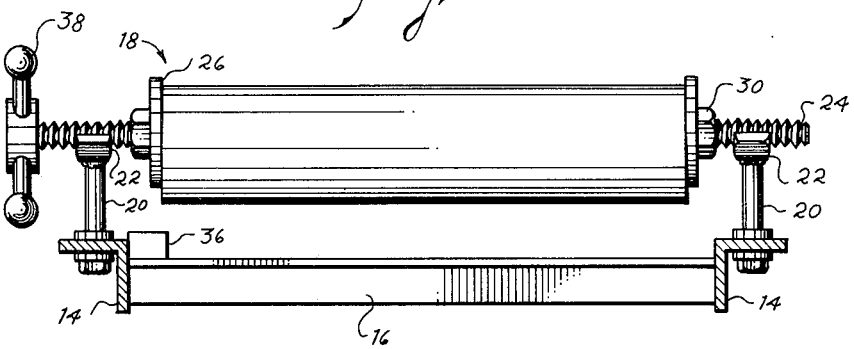
Fig. 7
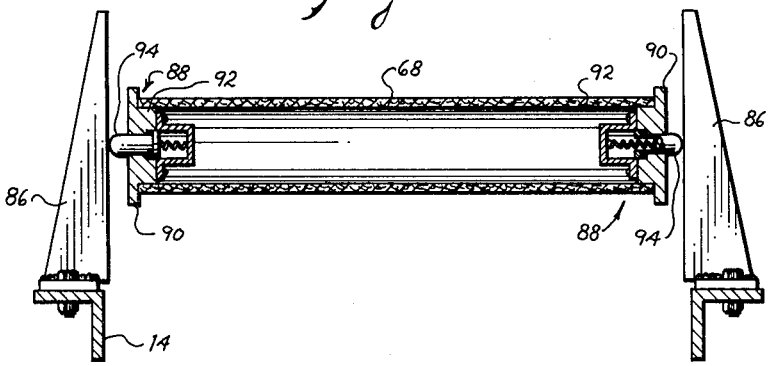
Fig. 6
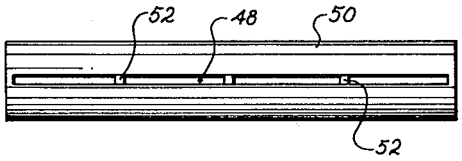
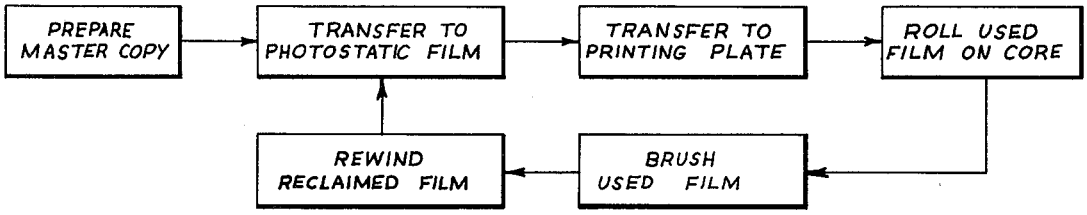
Fig. 8

FILM CLEANER

BACKGROUND OF THE INVENTION (1) Field of the Invention

The invention relates to photostatic film and more particularly to reclaiming the film so that it may be reused.

(2) Description of the Prior Art

As used herein, the term "photostatic film" is used to include all film made of a material, such as Mylar or a similar plastic, having a coating on one or more sides of a material, such as zinc oxide, which because of its light sensitive and electrostatic properties can be used in the process of lithographic or offset printing.

The term "bunny brush" refers to a type of brush having extremely soft bristles. This brush is familiar to those having ordinary skill in the art of printing or photocopying. The composition of the brush is particularly described in CLARKE's U.S. Pat. No. 3,615,813 at columns 3 and 4.

In the process of printing first a master copy is prepared. Then the master is transferred to photostatic film, said film photostatically attracting particles, usually carbon, in the pattern of the material. This film is then used to prepare the printing plate from which copies are printed. After the film is used once it is discarded. The film is very thin and any attempt to reclaim it which creases said film would render it unusable.

Specifically, photostatic film is used in printing newspapers. A master is prepared. Then, the master or the "layout" of the page is photostatically transferred to a long, wide web of photostatic film. Pyrofax Transfilm, a product of the Printing Products Division of 3M Company of Minnesota, is an example of such a photostatic film. One common form of this film is a web 19" (47.5 cm) wide and 900 feet (274.3 meters) long, which is wound upon a cardboard core. The cardboard core is a hollow cylinder with an internal diameter of about 3" (7.5 cm). Then, the image upon the photostatic film is transferred to printing plates for printing the copies of the newspaper. After the image has been transferred from the photostatic film to the printing plates, the used film is rolled upon a used core. In present commercial practice before this invention, the used film was then discarded.

SUMMARY OF THE INVENTION (1) New and Different Function

We have invented a novel way of reclaiming the used photostatic film. Instead of discarding the roll of film after only one use, by utilizing our invention, the film may be reclaimed and reused one or more times.

With our invention the used film is fed through a series of bunny brushes. The brushes are rotated by a motor driven chain. As the web of said film is fed through the rotating brushes, particles are accumulated by said brushes' bristles. A vacuum nozzle, adjacent to each bunny brush, removes the particles. After reclaiming, the web of film is carefully rolled onto a reclaimed core, without creasing the film. Then it is reused.

(2) Objects of this Invention

An object of this invention is to reclaim photostatic film.

Further objects are to achieve the above with a device that is sturdy, compact, durable, lightweight, simple, safe, efficient, ecologically compatible, energy conserving, and reliable, yet inexpensive and easy to manufacture, install, adjust, operate and maintain.

Other objects are to achieve the above with a method that is ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 1 is a side elevational view of a machine according to this invention with the web of film threaded therethrough.

FIG. 2 is a top plan view of the machine without the film.

FIG. 3 is a front elevational view of the used roll holder with the machine frame shown in section, taken substantially on line 3—3 of FIG. 2.

FIG. 4 is a sectional detail of one end of the used core and disc thereon, taken substantially on line 4—4 of FIG. 2.

FIG. 5 is a sectional view of a bunny brush and vacuum nozzle, taken substantially on line 5—5 of FIG. 2.

FIG. 6 is a bottom plan view of the vacuum nozzle as would be seen from line 6—6 of FIG. 5.

FIG. 7 is a sectional view of the reclaimed core, taken substantially on line 7—7 of FIG. 2.

FIG. 8 is a schematic flow chart showing the process.

DETAILED DESCRIPTION OF THE PREFERRED EMBODIMENT

Referring to the drawings there may be seen frame 10, which includes legs 12 attached to the top element. The top element includes two side rails 14 which are connected by braces 16. At one end of the frame is attached the used roll holder 18. The used roll holder includes two standards 20 which are conveniently attached to the side rails 14 of the frame 10. Half-nut 22 is attached on the top of each standard.

Shaft 24 is threaded from one end to the other and is commonly called an "all thread". It rests upon the half-nuts 22 as shown. The half-nuts and shaft have the same thread size.

Disc 25 is attached to each end of the shaft 24 inboard of the half-nuts 22. Each disc has outboard flange 26. Also, each disc 25 has cylindrical core holder 28. The core holder discs 25 are locked onto the shaft 24 by any convenient means. The preferred method is by having lock nut 30 on each side of each of the core holder discs. The lock means, i.e., lock nuts 30, adjust the core holder disc spacing so that the flanges fit against the ends of used core 32. Used roll of film 34 is wound upon the used core 32. The outboard flange 26 is a smaller diameter than the internal diameter of the used core. Therefore, to mount a used core upon the machine for reclamation, the shaft 24 is readily picked up and removed from the half-nuts and run through the center of the used core. The used core will drop down upon the core holder cylindrical portions 28 and be held in place against axial or endwise movement by the flanges 26.

Gauge 36 is mounted upon one of the top elements adjacent to the used roll holder 18. For proper operations, the edge of the film being fed from the used rollers should be exactly aligned with a mark on the gauge 36. If it is not so aligned, it can be readily brought in line by rotating the shaft 24. Rotation of the shaft 24 will move the shaft axially within the half-nuts 22. Hand wheel 38 upon the shaft provides a convenient means for rotating the shaft and thus shifting the shaft with the roll 34 thereon from side to side.

The used core 32 rotates upon the core holder 28 without rotating the core holder or the shaft 24. The friction of the threaded half-nuts 22 to the threads upon the shaft 24 will be greater than the friction of the used roll 34 rotating upon the core holder 28. The friction of the used core 32 upon the core holder 28 is desirable inasmuch as to properly control the film and keep it from creasing a certain amount of tension upon the film is desirable. We have found that the arrangement as described provides the proper amount of tension on the web of film as it is unrolled from the used roll 34.

A series of bunny brushes 40, each mounted upon brush shaft 42, are attached to the mid-section of the frame 10. For proper operation of the reclamation machine, it is necessary that the axes of the bunny brushes and the axes of the used core 32 upon the core holder all be parallel and at right angles to the web of film threaded through the machine. We have found that the bunny brushes are conveniently mounted in a hardwood block. Strip of hardwood 44 is bolted to each of the rails 14 on the frame 10. A bore is made for each of the brush shafts 42 and the brush shafts 42 are journalled through the holes. Oil holes are provided (not shown).

The holes through the hardwood strips 44 are in a single line, therefore, the axes of the bunny brushes are in a single line. The bunny brushes will be about 4" (10 cm) in diameter and the bunny brushes will be spaced about 8" (20 cm) on center.

Each bunny brush 40 will have vacuum nozzle 48 operatively associated therewith. The vacuum nozzle 48 will either be above or below the bunny brush depending upon the manner in which the web of film is threaded through a series of bunny brushes. It may be seen, as illustrated, the web goes over the first bunny brush, under the second, over the third, under the forth and over the fifth. Therefore, the nozzle would be under the first, third and fifth and over the second and forth bunny brush 40. However, those with ordinary skill in the art will understand the web could be threaded to go under the first and fifth bunny brush and over the middle three. In such an event the vacuum nozzles 48 would be relocated accordingly.

Each vacuum nozzle 48 is formed by cutting a slit in a plastic pipe such as polyvinyl chloride (PVC) pipe 50. We have had good success cutting a slot with a saw about $\frac{1}{8}$" wide in the pipe. To prevent the vacuum within the pipe from collapsing the pipe, we space two or three wooden spacers 52, $\frac{1}{8}$" thick, within the nozzle slot to hold it open. The pipes 50 are connected by suitable manifold 53 to the intake of blower 54.

The pipes 50 and, therefore, the vacuum nozzles 48 are mounted upon the frame 10 so that the bristles of the bunny brush touch the pipes, i.e., the bristles will be depressed as they are rotated by the nozzles. This touching or depression is very slight. It will be seen that the blower forms means for moving air from each vacuum nozzle.

So the web is properly threaded to the machine, idler roller 56 is attached to the frame 10 between the used roll holder 18 and the series of bunny brushes 40. The idler roller 56 is mounted in conventional bearings upon suitable standards attached to the side rails 14 of the frame 10.

The bunny brushes are rotated by gear motor 58 which is attached to the frame 10. Drive sprocket 60 is mounted to the output shaft of the gear motor. Chain 62 extends from the drive sprocket 60 to brush sprockets 64. One of the brush sprockets are mounted on each brush shaft 42. Idler sprocket 66 is provided to properly train the chain 62 around the brush sprockets 64. The chain is trained around the brush sprockets so that the rotation of the brush as it contacts the web of film will be opposite to the direction of travel of the web of film.

We have had good success moving the web of film at about 180 feet per minute (55 meters) and also to have the peripheral speed of the bunny brushes to be about 180 feet per minute (55 meters per minute).

The web of reclaimed film is wound upon reclaimed core 68. As indicated previously, it is necessary for the reclaimed core 68 and reclaimed cylinders 70 and 74 be parallel to the axes of the bunny brushes 40 and to be at right angles to the web of film. The reclaimed core 68 and reclaimed roll of film 72 which may be mounted upon it are supported by the spaced apart rewind cylinders 70 and 74. Rewind cylinder 70 is driven by rewind gear motor 76 by rewind belt 78.

Inasmuch as the reclaim core 68 or roll 72 rests upon the two rewind cylinders 70 and 74, therefore, it may be seen that rotation of the rewind cylinder 74 will rotate the rewind core resting upon them. Also it will be understood that it is necessary for the rewind cylinders 70 and 74 to have less than 3" clearance between them or else the standard 3" core would fall between them instead of being supported between them.

Also, it will be understood that if there is no slippage, as there is not, between the driven rewind cylinder 70 and the reclaimed roll of film 72 the distance traveled by surface of the rewind cylinder 70 will be the amount of film wound. Therefore, a simple wheeled counter 80 is mounted upon resilient stand 82 which is attached to the frame 10. The counter wheel is pressed against the surface of rewind cylinder 70 by the resilient stand 82. Therefore, if at the beginning of each of the rewind rolls 72 the counter is reset to zero it will indicate the length of film rolled upon the reclaimed core 68.

The rewind cylinders 70 and 74 are mounted upon suitable stands and conventional bearings to the frame 10.

In order to maintain the reclaimed core 68 and the reclaimed roll of film 72 in proper position, guide bar 86 is mounted to the side rail 14 of the frame 10 on each side of the reclaim core 68 between the rewind cylinders 70 and 74. We have had good success using one of the legs of the angle iron for the guide bar 86.

Spring disc 88 is snuggly placed in the end of the reclaim core 68. The spring disc 88 will have an outboard flange 90 and an internal cylinder 92 which snuggly fits the inside diameter of the reclaim core 68. Each disc 88 will have a spring biased plunger 94 at the axis thereof. The spring biased plunger will bear against the guide bar 86, thereby holding the reclaimed core and thus the reclaimed roll of film 72 centered.

A series of guide rollers 96 are attached to the frame by suitable standards and conventional bearings between the series of bunny brushes 40 and the rewind cylinders 70 and 74. The last of these guide rollers has a large outboard flange 98 thereon to guide the film. The guide rollers 96 insure that the proper tension will be placed upon the film and that the film will be properly guided to be smoothly pulled from the used core 32 to the reclaim core 68 as well as to insure that the film will neither be creased nor threaded at an angle.

Also, those having skill in this art will know that the photostatic film is itself light sensitive and will have a treated side and a metallic side. The series of guide rollers 96 will reverse the film on the roll. I.e., on the used roll 34 the treated side will be out but after its reclamation and passing through the rollers that upon the reclaimed roll 72 the metallic side will be out. That is, the film is reversed upon the rolls between the used roll and the reclaimed roll. Also, inasmuch as the film is light sensitive, the process is performed either in darkness or with non-sensitive light, such as conventional red light. This darkness or red light is referred to as controlling lighting.

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawings, the following catalog of elements is provided:

| | |
|---|---|
| 10 frame | 54 blower |
| 12 legs | 56 idler roller |
| 14 side rails | 58 gear motor |
| 16 braces | 60 drive sprocket |
| 18 used roll holder | 62 chain |
| 20 standards | 64 brush sprocket |
| 22 half-nut | 66 idler sprocket |
| 24 shaft | 68 rewind core |
| 25 disc | 70 rewind cylinders |
| 26 flange | 72 reclaimed roll of film |
| 28 core holder | 74 rewind cylinder |
| 30 lock nut | 76 rewind gear motor |
| 32 used core | 78 rewind belt |
| 34 used roll | 80 counter |
| 36 gauge | 82 resilient stand |
| 38 hand wheel | 86 guide bar |
| 40 bunny brush | 88 disc |
| 42 brush shaft | 90 outboard flange |
| 44 hardwood | 92 cylinder |
| 48 vacuum nozzle | 94 plunger |
| 50 pipe | 96 guide rollers |
| 52 spacers | 98 flange |
| 53 manifold | |

SUBJECT MATTER CLAIMED FOR PROTECTION

We claim as our invention:

1. A machine for reprocessing a rolled web of photostatic film, the web being about 19 inches (47.5 cm) wide and about 900 feet (274.3 meters) long and very thin and easily creased which if creased renders it unusuable, said machine comprising:

a. a frame,
b. a used roll holder on the frame,
c. a series of cylindrical bunny brushes rotatably mounted on the frame,
d. a series of vacuum nozzles on the frame, one contacting each bunny brush,
e. blower means for removing air from each vacuum nozzle operatively associated therewith,
f. two rewind cylinders on the frame,
g. a reclaimed core resting on the rewind cylinders,
h. said used roll holder, all the bunny brushes, rewind cylinders and reclaimed core having axes which are parallel to each other, and
i. rotating means on the frame for rotating each of the bunny brushes and one of the rewind cylinders.

2. The inventon as defined in claim 1 wherein each vacuum nozzle includes j. a plastic pipe parallel to the bunny brush axis,
k. an axial slit in the pipe, and
l. spacer chips in the slit to prevent the vacuum in the pipe from closing the pipe.

3. The invention as defined in claim 1 further comprising:

j. two guide bars attached to the frame between the rewind cylinders,
k. a spring disc in at least one end of the reclaimed core,
l. a spring plunger extending axially from the spring disc and pressing against one of the guide bars.

4. The invention as defined in claim 1 further comprising:

j. guide rollers having axes parallel to said rewind cylinders on the frame, and
k. the web of film threaded from a core on the used roll holder, through the series of bunny brushes, by the guide rollers and to the reclaimed core.

5. The invention as defined in claim 4 wherein the used roll is upon a used roll core having an internal diameter, and the roll holder includes l. a shaft threaded at both ends,
m. a disc on the shaft at each end thereof,
n. the disc having an outboard flange larger than the diameter of a cylindrical core holder area of the disc,
o. said outboard flange having a diameter smaller than the internal diameter of the used roll core,
p. said disc on the threaded shaft so that the outboard flanges fit against the ends of the core,
q. standards on the frame,
r. an upward turned threaded half nut at the top of each standard,
s. said threaded shaft resting in said half nuts outboard of said discs, and
t. a hand wheel on the threaded shaft for rotating the shaft, thus shifting the used roll for centering the film on the frame.

6. The invention as defined in claim 5 wherein each vacuum nozzle includes u. a plastic pipe parallel to the bunny brush axis,
v. an axial slit in the pipe, and
w. spacer chips in the slit to prevent the vacuum in the pipe from closing the pipe.

7. The invention as defined in claim 6 further comprising:

x. two guide bars attached to the frame between the rewind cylinders,
y. a disc in at least one end of the reclaimed core,
z. a spring plunger extending axially from the spring disc and pressing against one of the guide bars.

* * * * *